US007000370B2

(12) United States Patent
Bryant et al.

(10) Patent No.: US 7,000,370 B2
(45) Date of Patent: Feb. 21, 2006

(54) APPARATUS AND METHOD FOR STRETCH-WRAPPING ARTICLES

(75) Inventors: Adam T. Bryant, Aptos, CA (US); Arnold Lipes, Montreal (CA); Bruno Wetter, Montreal (CA)

(73) Assignee: International Paper Company, Stamford, CT (US)

( * ) Notice: Subject to any disclaimer, the term of this patent is extended or adjusted under 35 U.S.C. 154(b) by 197 days.

(21) Appl. No.: 10/632,677

(22) Filed: Aug. 1, 2003

(65) Prior Publication Data

US 2005/0022475 A1 Feb. 3, 2005

(51) Int. Cl.
*B65B 49/00* (2006.01)

(52) U.S. Cl. ..... 53/577; 53/228

(58) Field of Classification Search ..... 53/145, 53/559, 562, 577, 574, 228, 230
See application file for complete search history.

(56) References Cited

U.S. PATENT DOCUMENTS

| | | | | |
|---|---|---|---|---|
| 3,245,198 A | | 4/1966 | Schmied | |
| 3,851,440 A | | 12/1974 | Horsky | |
| 4,525,983 A | | 7/1985 | Libow | |
| 5,699,655 A | * | 12/1997 | Kuboyama et al. | 53/540 |
| 5,794,410 A | | 8/1998 | Harper | |

* cited by examiner

*Primary Examiner*—John Paradiso
(74) *Attorney, Agent, or Firm*—Matthew M. Eslami

(57) ABSTRACT

Apparatus and process for stretch wrapping articles, especially heads of lettuce, wherein a roll (23) of film (24) is supported on a housing (21), and the film is supplied from the roll around a dancer roller (50) and film feed roller (51) to a pair of film feed grippers (33, 34) which grip a leading edge of the film and advance it past an opening (26), whereupon a clamp (27) engages the leading edge of the film to hold it while the grippers release and return to their home position. Additional clamps (28–32) then engage the film to hold it in place over the opening. A head of lettuce (L) is placed on the film in centered relation to the opening, and a ram (37) engages the lettuce and pushes it against the film to stretch the film through and below the opening. Gathering bars (38, 39) engage the film stretched between the opening and the head of lettuce to gather the film in a first direction, and a U-channel (40) and sealing and trimming mechanism (41) gather the film in a second direction to produce a narrow necked down section of gathered film, fuse and seal the necked down section to produce a wrapped head of lettuce, trim excess film from the lettuce, and release the wrapped head of lettuce to drop onto a take away conveyor. The film (24) is a polyethylene based multi-layer film with an outer polypropylene layer for added gloss, slip and clarity, has a 300% stretch capability, is FDA approved for direct food contact, has an anti-fog additive for moisture dissipation during temperature fluctuations, is thirteen microns thick, and has a width of sixteen inches.

17 Claims, 12 Drawing Sheets

APPARATUS AND METHOD FOR STRETCH-WRAPPING ARTICLES

TECHNICAL FIELD

This invention relates to packaging of articles, and particularly to the packaging of fresh produce such as lettuce, cauliflower, and the like. More specifically, the invention relates to an apparatus and method for stretch-wrapping fresh produce in a transparent film at the point of harvest.

BACKGROUND ART

Fresh produce is harvested and packaged so that it can be stored and transported to arrive in a fresh condition at remote destinations. Iceberg lettuce, for example, is manually cut and placed by hand in a pre-formed standard lettuce bag that is vented to promote effective vacuum cooling. The bag is manually taped closed, and twenty-four to thirty heads of the bagged lettuce are packed in cases to achieve a minimum gross carton weight of about fifty pounds. This process typically requires a team of twenty-four to twenty-eight people organized into groups of two cutters and one taper/packer. A team can pack an average of two hundred fifty cases per hour on an average production day. The teams work behind a harvester machine comprising two elongate wings projecting from opposite sides of a trailer, with each wing incorporating a plurality of bagging and taping stations. The machine is moved through a lettuce field in spanning relation to rows of lettuce, which is harvested by the team as the machine advances through the field. This method of harvesting iceberg lettuce has remained basically unchanged over the past thirty years.

The cartons of bagged lettuce are palletized by hand, put on a trailer, and sent to a plant to be vacuum cooled prior to storage in a cold storage facility and subsequent shipment to a point of sale, where the bagged lettuce will arrive fresh and ready for display and sale.

Efforts have been made in the prior art to at least partially automate the process of harvesting and bagging lettuce, as exemplified, for example, by U.S. Pat. No. 3,245,198 to Schmied, U.S. Pat. No. 3,851,440 to Horsky, U.S. Pat. No. 4,525,983 to Libow, and U.S. Pat. No. 5,794,410 to Harper. These patents all relate to at least partially automated bagging equipment which functions to push a head of lettuce against a plastic film wrap so that the head of lettuce is enclosed by the wrap, rotate the bagged head of lettuce to twist and gather excess wrap material above the head of lettuce, sever the wrap above the twisted portion, and then heat seal it by applying heat to the gathered twisted portion of wrap. Although these prior art systems should help reduce the labor requirements of harvesting and bagging lettuce, they are not entirely satisfactory because they either use too much material, and/or produce an unsightly package, and/or take an excessive amount of time due to the steps required, and/or damage the produce by applying heat and/or excessive force to it.

To date, no commercially viable packaging system has been designed to address the packer's desires for increased productivity, reduced labor costs, improved package appearance, and reduction in the amount of plastic used.

DISCLOSURE OF THE INVENTION

The present invention provides an apparatus and method for packaging articles, and especially freshly harvested produce in a way to achieve increased productivity, reduced labor costs, improved package appearance, and reduction in the amount of plastic used.

The apparatus of the invention is designed so that it can be mounted to a conventional harvester in place of the conventional bagging devices that are currently used. It includes means for holding and supplying under tension a unique stretch wrap film, means for advancing the film to a wrapping station, means for holding the film in place, means for pushing the article, e.g. head of lettuce, against the film to stretch it and form a bag-like enclosure around the head of lettuce, means for gathering the film behind the head of lettuce, and means for sealing the gathered film, severing it, and conveying the shrink wrapped head of lettuce away from the wrapping station.

More specifically, the apparatus comprises a frame having means for mounting it to a conventional harvester. A roller is positioned to support a roll of stretch film, which is unwound from the roller and fed under a dancer bar and an unwind roller and attached at its leading edge to a film feed gripper. The dancer bar and unwind roller maintain a predetermined light tension on the strip of film. The film feed gripper is cycled forwardly, carrying the strip of film with it to a wrapping station, where the film is gripped and held in place by clamps fore and aft and at opposite sides of the wrapping station to define a rectangularly shaped web of the film having a size predetermined to be sufficient to stretch wrap a head of lettuce. The film feed gripper then releases the film and returns to its home position where it grips the strip of film in preparation for another cycle. The strip of film is then severed at a position between the film feed gripper and the clamps.

A freshly cut head of lettuce is placed on a holder, and an operator then presses a cycle button to move the head of lettuce into position centered over the clamped film web. A ram then moves against the head of lettuce, pressing it against the film web, while the holder moves out of the way. The ram continues to press the head of lettuce against the film, stretching it to a point approximately twelve inches below its at-rest position. The ram and holder then return to their home positions in preparation for another cycle.

The stretched overwrap film is then gathered in two stages, by a pair of gathering arms which first move toward one another in a first direction against the film to gather it into a relatively wide flattened condition, and then by a sealing and trimming unit and U-channel which move in a direction transverse to the first direction toward one another against the partially gathered film to further gather the film into a narrow, necked down condition. A heated block in the sealing and trimming unit then closes onto the gathered neck of the film, both sealing it and severing it from the excess film above the seal. A pair of pinch fingers grips the excess film and pulls it away for release to a collection system such as, e.g., a vacuum, and the sealing unit releases the wrapped lettuce to a take-away conveyor.

Simultaneously with release of the wrapped lettuce, the film feed gripper again advances a strip of film to the wrapping station, where the film is clamped by the clamps in preparation for wrapping another head of lettuce.

The film is a mostly polyethylene based seven layer composition with an outer polypropylene layer for added gloss, slip and clarity, and has a 300% stretch capability. It is FDA approved for direct food contact, and has an anti-fog additive for moisture dissipation during temperature fluctuations. In the preferred embodiment, the film has a width of sixteen inches and is thirteen microns thick.

A label insert mechanism can be provided for inserting a label onto the strip of film as it is advanced to the wrapping station. Further, a film perforating mechanism can be positioned to form small holes in the stretched film before it is gathered and sealed. The holes are formed slightly above the center of the lettuce head, where the stretched film is spaced from the lettuce prior to the film being gathered and sealed, and in the finished package permit the product to be vacuum cooled.

The apparatus of the invention can cycle sixteen times per minute to automatically shrink wrap a head of lettuce with a fifteen inch by fifteen inch web of ultra clear, anti-fogging, highly stretchable film FDA approved for direct contact with the lettuce. Use of the invention would enable a reduction of 21.5% in the number of field workers required, with a concomitant reduction of 38% in labor costs per case, while achieving a 30% increase in the rate of harvester production, with a 37% reduction in the amount of film needed to wrap a head of lettuce. The cost associated with taping the wrapped head of lettuce would also be eliminated, and the final appearance of the wrapped head of lettuce would be greatly improved, with a high gloss, ultra clear film that has anti-fogging properties and is superior to conventional industry standard LDPE lettuce packaging.

The film itself, the film advancing and clamping means, and the film gathering, sealing and severing means are all unique and result in an economical and efficient packaging system which produces a package with superior appearance and performance characteristics.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

BEST MODE FOR CARRYING OUT THE INVENTION

Figure 1:
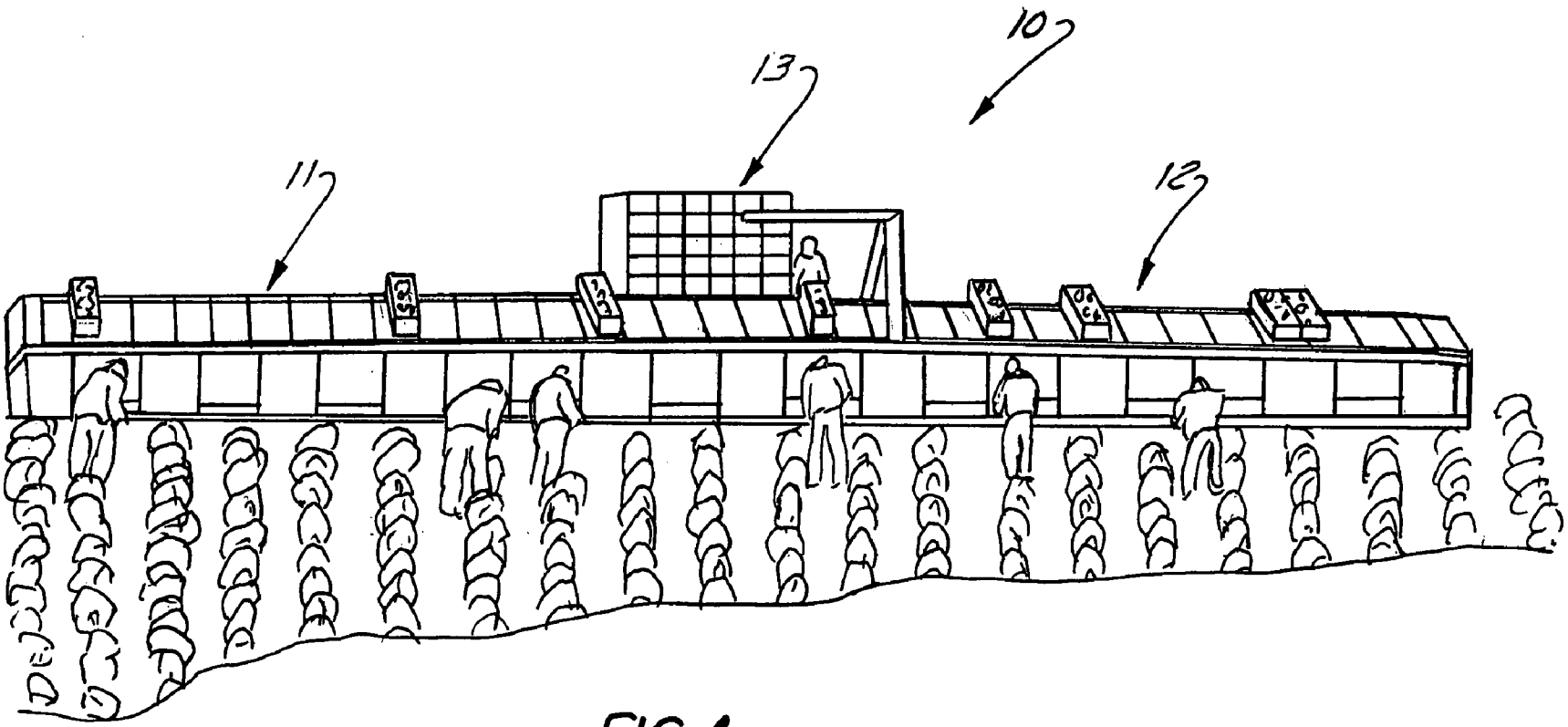
FIG. 1 PRIOR ART
FIG. 1 is a rear perspective view of a conventional lettuce harvesting machine.

A conventional lettuce harvesting machine is indicated generally at 10 in FIG. 1. This machine comprises two elongate wings 11 and 12 extending outwardly from a central loading station 13 where filled cases of bagged lettuce are loaded onto a trailer. A plurality of lettuce bagging and taping stations are spaced along each arm. In a typical operation, as the machine is moved through a field, lettuce is manually cut and placed by hand in a pre-formed standard lettuce bag that is vented to promote effective vacuum cooling. The bag is manually taped closed, and twenty-four to thirty heads of the bagged lettuce are packed in cases to achieve a minimum gross carton weight of about fifty pounds. This process typically requires a team of twenty-four to twenty-eight people organized into groups of two cutters and one taper/packer.

Figure 2:
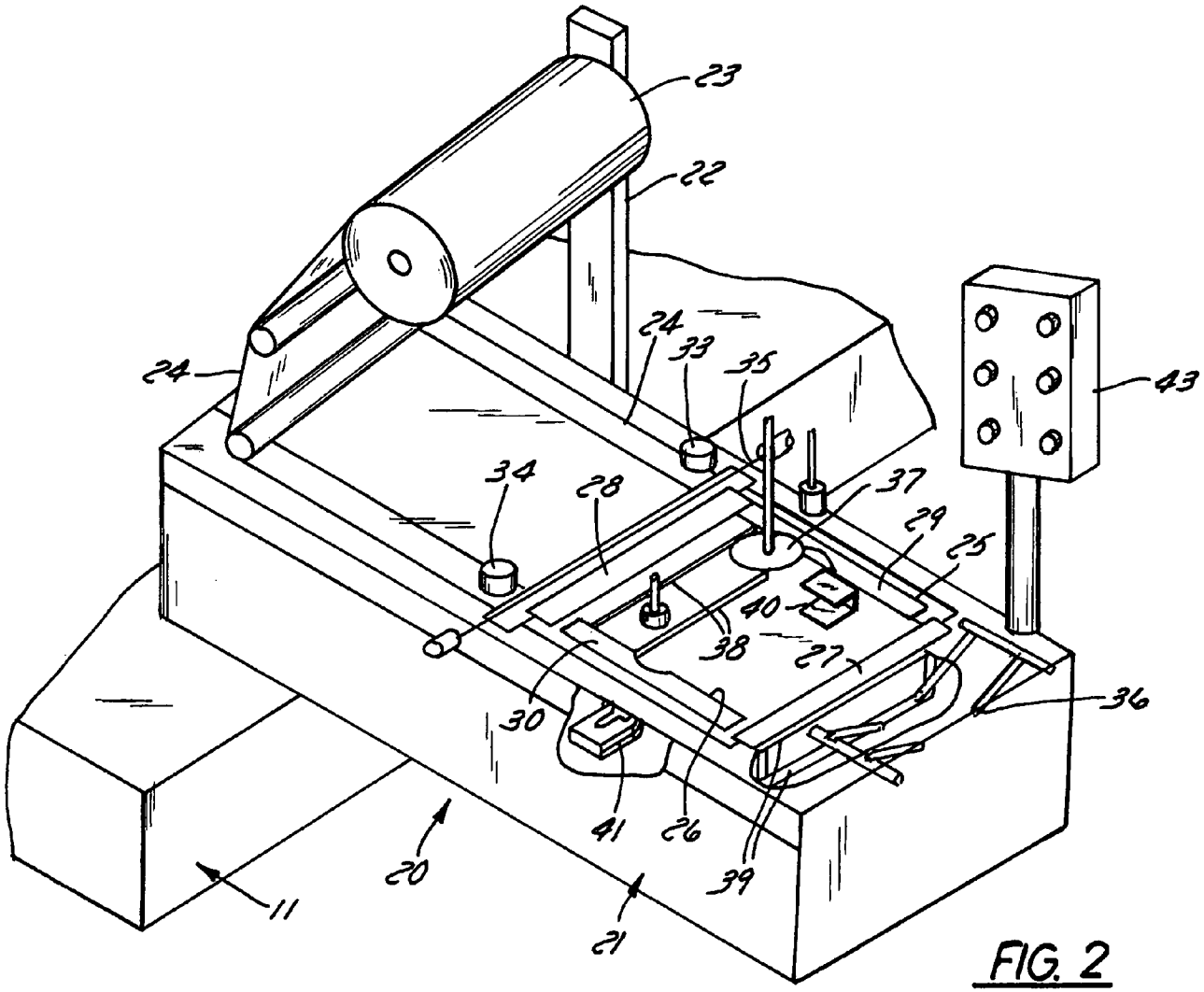
FIG. 2 is a fragmentary, schematic, rear perspective view of a portion of the harvesting machine of FIG. 1, with the stretch wrapping apparatus of the invention applied thereto.
Figure 3:
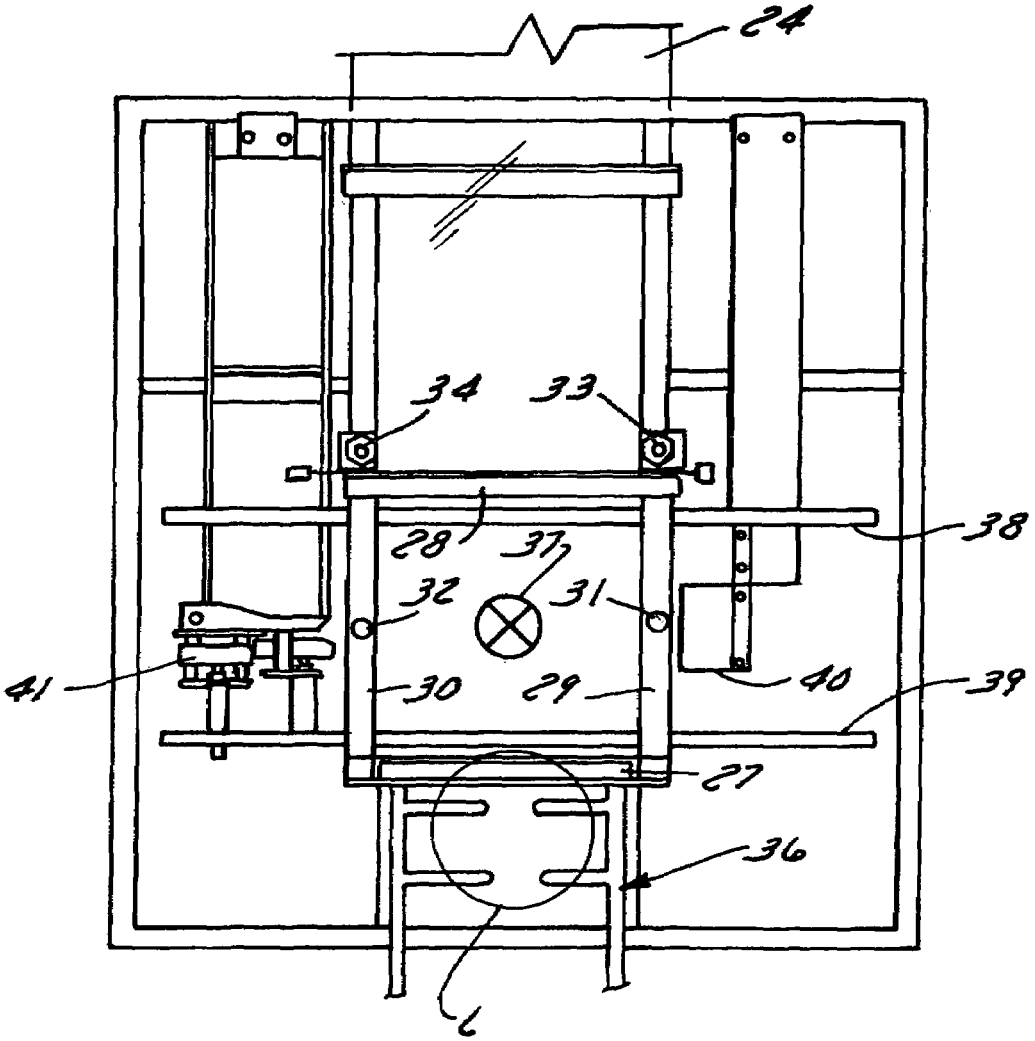
FIG. 3 is somewhat schematic top plan view of the stretch wrap apparatus of the invention.
Figure 4:
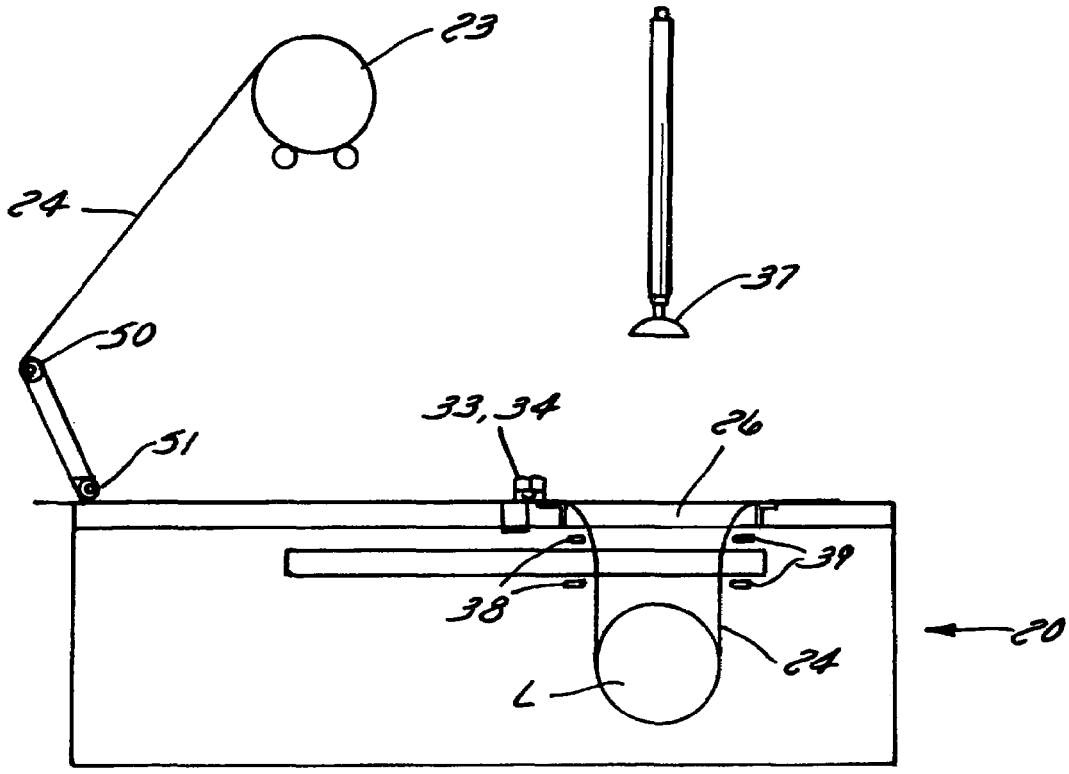
FIG. 4 is a somewhat schematic side view in elevation of the shrink wrap apparatus of the invention.

FIG. 2 shows the stretch wrapping apparatus 20 of the invention mounted to a wing 11 of a conventional lettuce harvesting machine. In use, it is contemplated that four of the stretch wrapping apparatuses would be mounted to each arm of the harvesting machine.

As schematically depicted in FIG. 2, wherein portions are cut away for purposes of illustration, the apparatus 20 comprises a frame or housing 21 that is attached to the wing 11. The apparatus includes means 22 near the distal end of the housing for supporting a roll 23 of unique stretch wrap film 24. A plurality of clamps 25 near the other, proximal end delineate a generally square area or opening 26 that defines a wrapping station. The clamps include a front clamp 27, a rear clamp 28, a pair of side clamps 29 and 30, and a pair of center side clamps 31 and 32. These clamps hold the strip of film securely around the opening, forming a section of film for stretch wrapping a head of lettuce or other article.

Two film feed grippers 33 and 34 are positioned to the rear of rear clamp 28 at opposite sides of the film for feeding the strip of film forwardly over the opening, and a heated film severing wire 35 is positioned between the rear clamp and the film feed grippers for severing the section of film held over the opening from the strip of film.

Opposed sets of pivoted fingers 36 are supported at the near end of the housing, forward of the opening 26, for receiving and supporting a head of lettuce or other article. The arms are movable into and out of position centered over the opening, and are pivotable to release the lettuce or other article onto the web of film held across the opening.

A ram 37 is supported above the center of the opening and is movable downwardly to engage a head of lettuce placed on the film and to push the lettuce downwardly through the opening, stretching the film to form a bag-like enclosure tightly surrounding the lower hemisphere of the head of lettuce.

Opposed gathering arms 38 and 39 of generally open rectangular configuration are supported below the opening 26 in positions fore and aft of the opening, and are movable toward and away from one another in a direction parallel to the length of film to gather the excess film above the head of lettuce into a generally flattened condition.

A U-channel member 40 is supported at one side of the opening, generally midway between the opposed gathering arms, and a sealing and trimming unit 41 is supported in opposed relationship to the U-channel 40. The sealing unit and U-channel are movable toward and away from one another in a direction transverse to the direction of movement of the gathering arms 38 and 39, for compressing the flattened excess film into a narrow neck immediately above the head of lettuce. A heated sealing element 42 (see FIGS. 12–15) is movable against the gathered neck of film to seal it and sever the excess film from the wrapped head of lettuce.

A control panel 43 is mounted adjacent the near or forward end of the apparatus for access by an operator.

Further details of the film advancing and clamping means can be seen with particular reference to FIGS. 2–9. Initially, the clamps 27–34 are all in their raised positions as depicted in full lines in FIG. 9. The operator grasps the strip of film 24 and unwinds a length of it from the roll 23, feeding the strip of film around dancer roller 50 and unwind roller 51. The strip of film is then pulled forwardly over the frame to position the end of the film beneath the film feed grippers 33 and 34, with the end of the film preferably extended several inches beyond the grippers. The operator then presses a button on the control console 43 to operate actuator means to cause the grippers to be lowered onto the end of film, clamping it between the grippers and underlying slides 52. Another button on the console is then pressed, causing the heated cut-off wire 35 to be lowered onto the film, cutting off the excess material extending beyond the grippers. The operator then pushes a further button, causing the grippers and slides to move forward on the frame until they are at the forward end of the frame, carrying the strip of film over and beyond the opening 26. Actuator means then lowers the front clamp 27 onto the end of the film in the area between the grippers to hold the film in place, whereupon the grippers release from the film and retract to their home position, where they again lower onto the strip of film.

Figure 5:
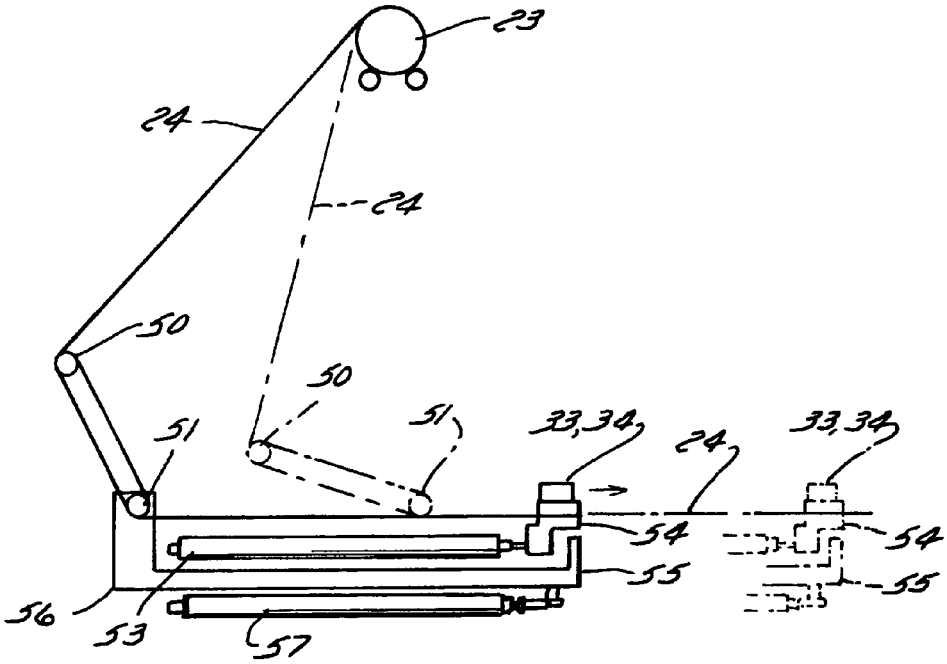
FIG. 5 is a schematic side view in elevation of the film advance mechanism, depicting it in full lines in its retracted, at-home position, and in broken lines in its extended position.
Figure 6:
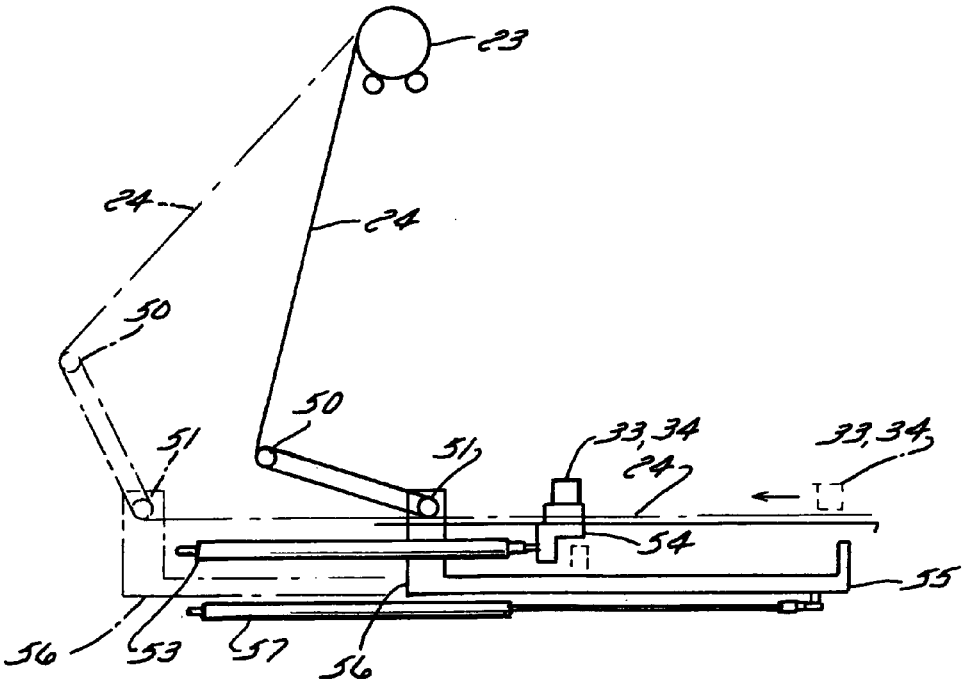
FIG. 6 is a view similar to FIG. 5, depicting the film feed gripper means in retracted position, and the film unwind means in extended position in full lines and retracted position in broken lines.
Figure 7:
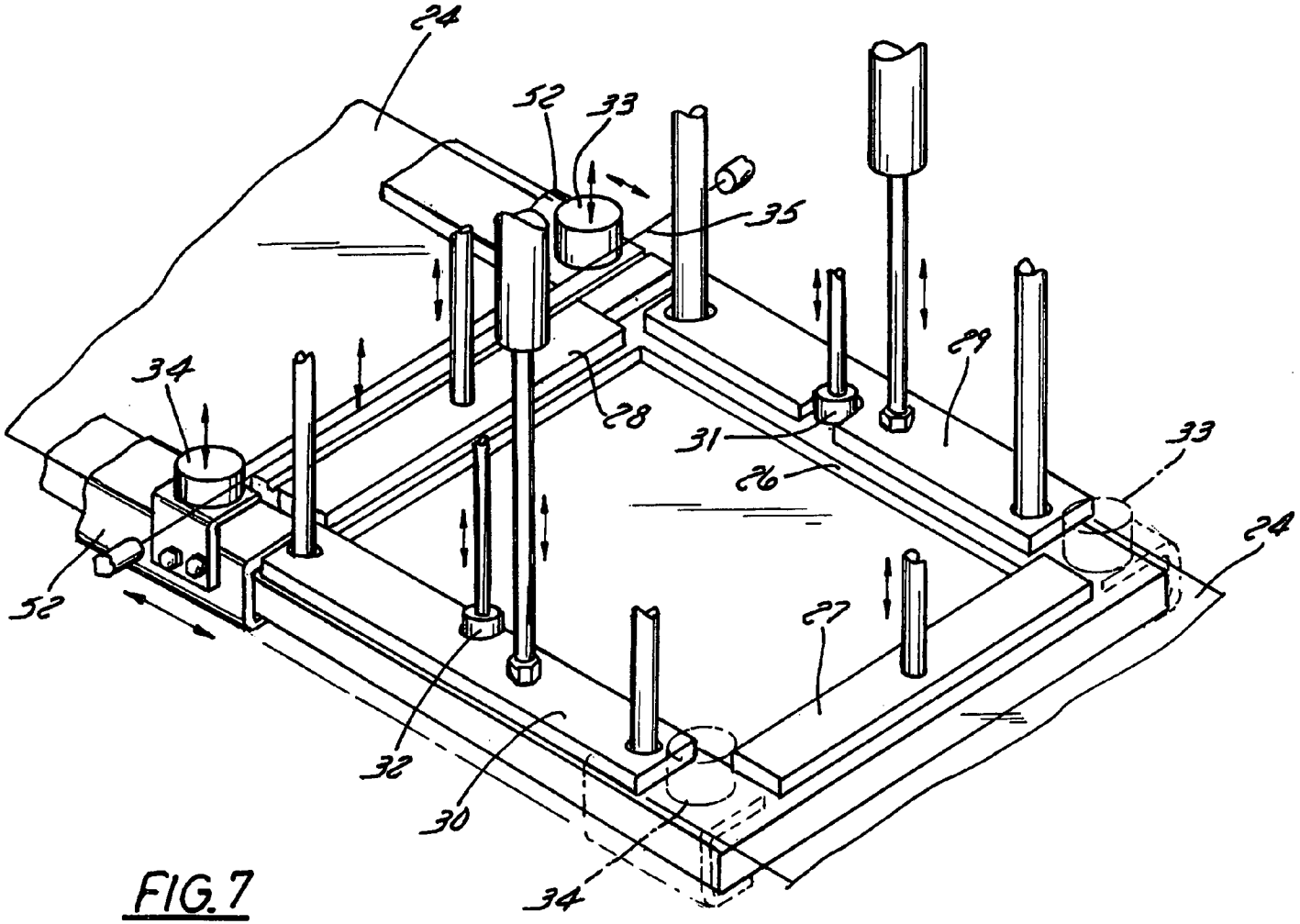
FIG. 7 is a fragmentary top perspective view of a portion of the stretch wrapping apparatus of the invention, showing the clamping means in greater detail.
Figure 8:
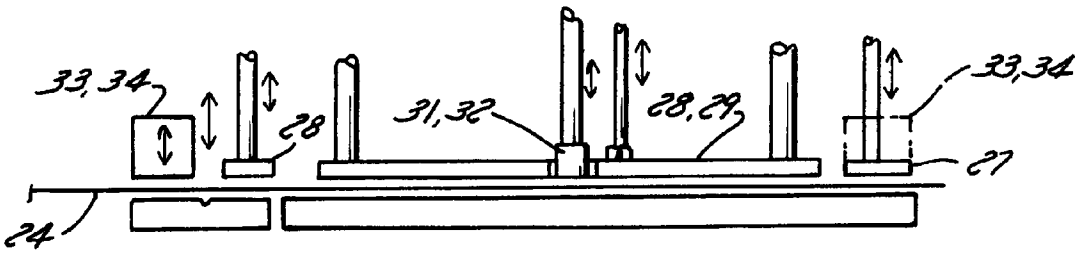
FIG. 8 is a somewhat schematic side view in elevation of the film advancing and clamping apparatus of FIG. 7, with all clamps in their lowered position to clamp the film, but shown slightly spaced from the film for purposes of clarity and illustration.
Figure 9:
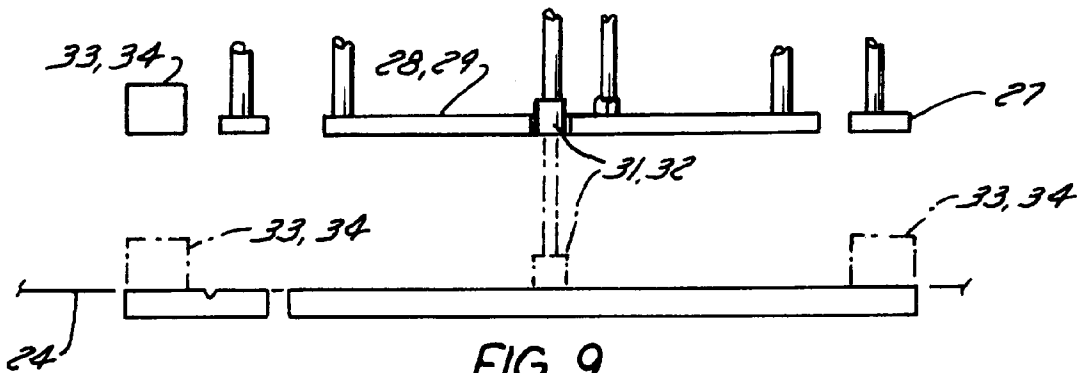
FIG. 9 is a view similar to FIG. 8, with all clamps except the film feed grippers and center side clamps in their raised positions, and the film feed grippers shown in full lines in their retracted position and in broken lines in their fully advanced position.
Figure 10:
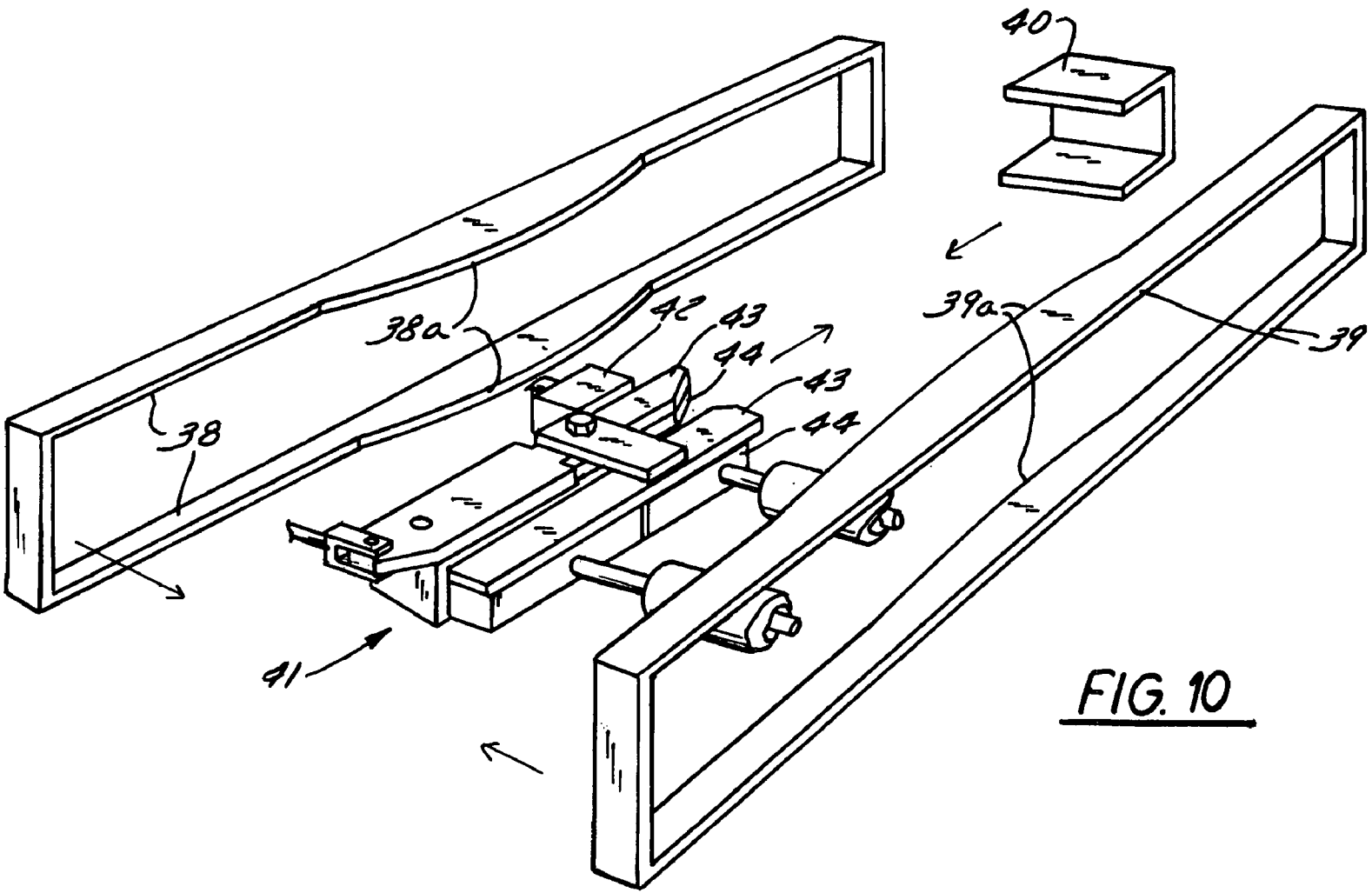
FIG. 10 is an enlarged exploded fragmentary perspective view of the gathering and sealing means in the apparatus of the invention.
Figure 12:
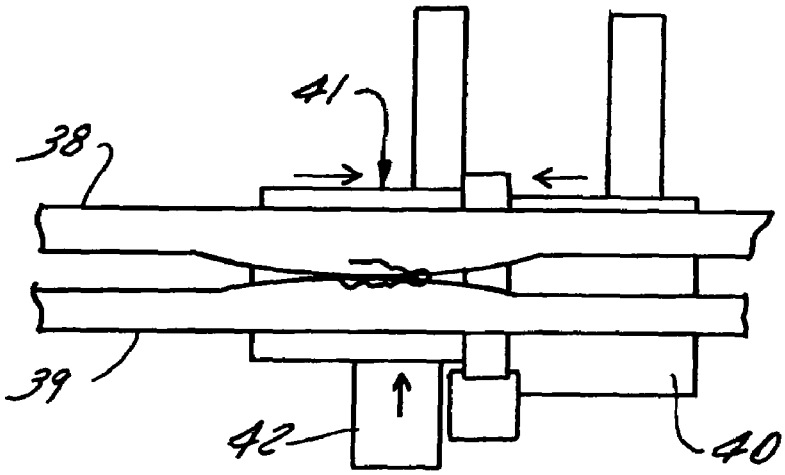
FIG. 12 is a view similar to FIG. 11, showing the U-channel and pinch fingers moved into proximity with one another to gather the film into a necked down area of small cross-section so that the heated sealing bar can contact the necked down area to seal it and sever the wrapped article from the excess material.
Figure 11:
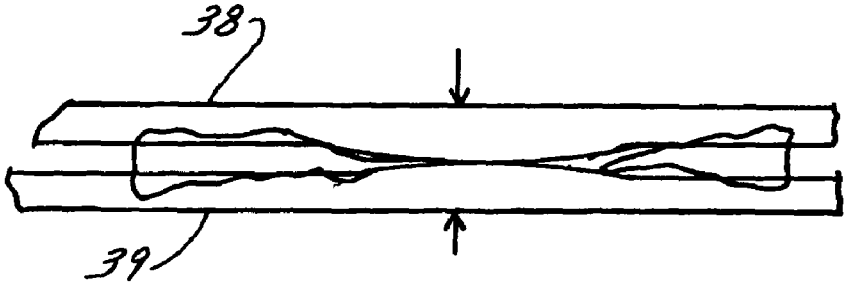
FIG. 11 is a fragmentary schematic plan view of the gathering arms moved into proximity with one another to partially gather the stretched film into a flattened condition.
Figure 16:
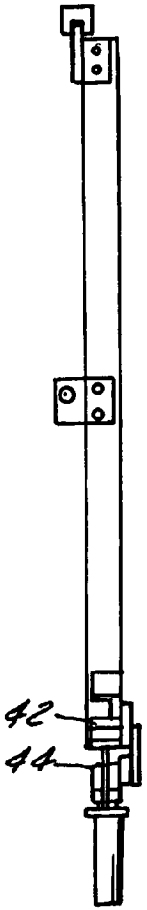
FIG. 16 is a side view in elevation of the mechanism of FIG. 13.
Figure 15:
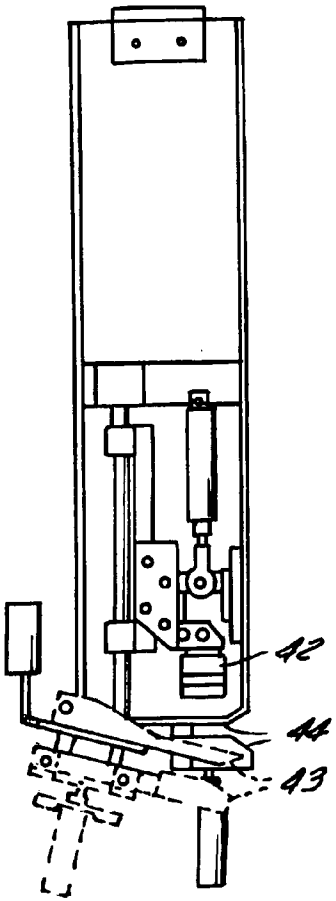
FIG. 15 is a view similar to FIG. 13, showing the pinch fingers in broken lines in rotated position to pull the excess film away, the fingers being shown here in opened position to release the excess film.
Figure 14:
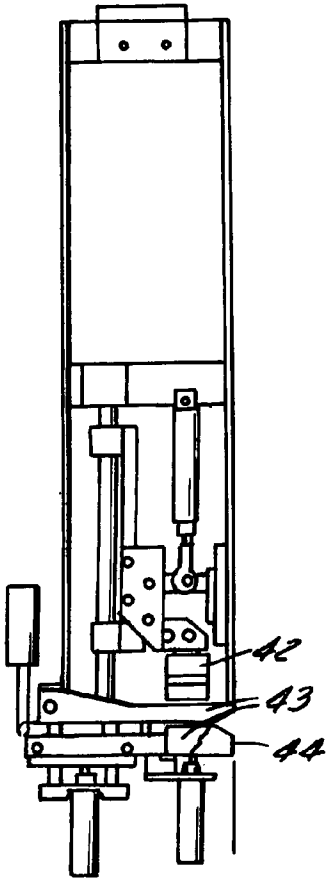
FIG. 14 is a view similar to FIG. 13, but showing the pinch fingers of the sealing means in closed position to grip excess film above the gathered portion.
Figure 13:
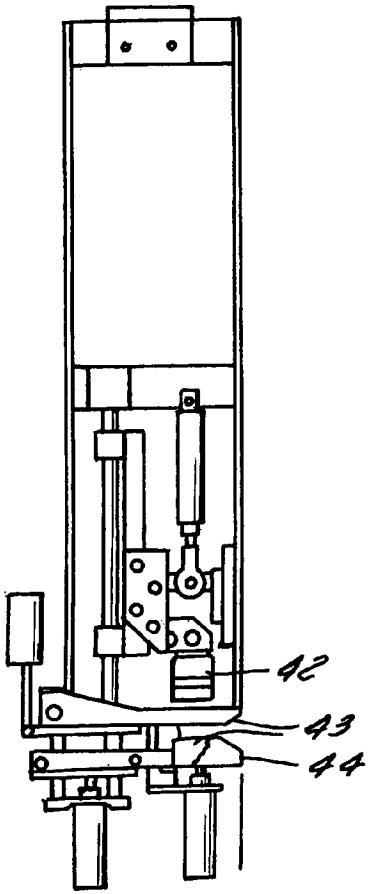
FIG. 13 is a schematic plan view of the film sealing and severing means, depicted in open position for receiving a partially gathered portion of the film preparatory to sealing it.
Figure 18:
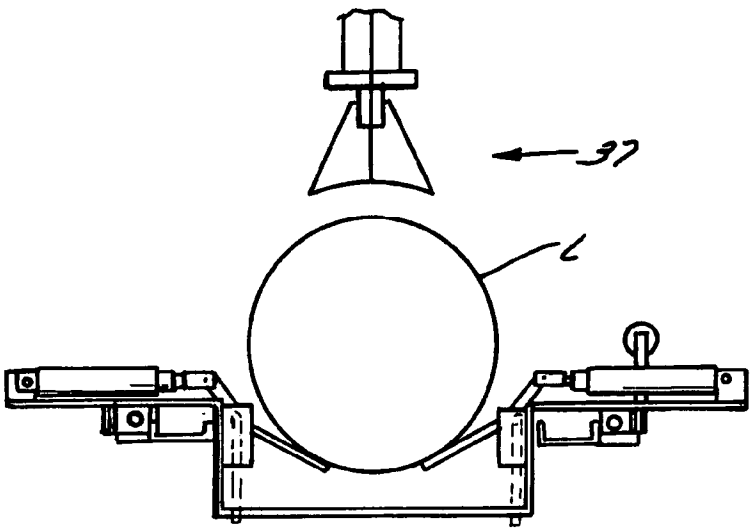
FIG. 18 is a fragmentary side view in elevation of the article feed mechanism of FIG. 15, showing the pivoted fingers in full lines in position for supporting an article, and in broken lines for releasing the article.
Figure 17:
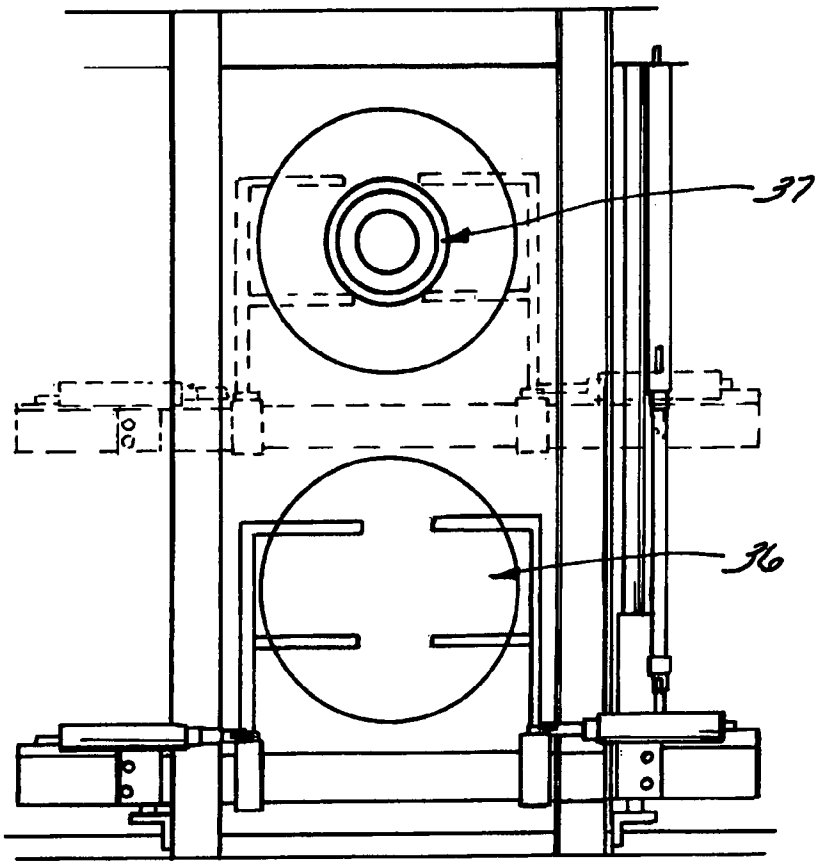
FIG. 17 is a fragmentary, schematic top plan view of the article feed mechanism used to convey the article to the wrapping station, showing the mechanism in full lines in retracted position for receiving an article, and in broken lines in extended position for depositing the article onto the web of film.

With particular reference to FIGS. 5 and 6, it will be noted that the grippers are moved forward and retracted by an actuating means 53. A pusher 54 carried by the actuator means also acts through a lug 55 and link 56 to carry the unwind roller 51 forwardly, releasing tension on the film strip as the grippers and pusher are moved forward. Upon reverse movement of the actuator 53 and the grippers, however, the pusher moves free of the lug 55 so that the link 56 and the unwind roller 51 are not also carried to the rear by actuator 53. This feature is important, since the grippers are moved rapidly to the rear in order to quickly reposition them, and this rapid movement would impose too much tension on the film. The link 56 and unwind roller 51 are carried more slowly to the rear by a separate actuator 57, ensuring that this movement is carried out in a manner to gradually unwind the film from the roller without imposing undue stress on the film.

As soon as the grippers are retracted, the rear clamp 28, side clamps 29 and 30, and center side clamps 31 and 32 all lower onto the film, securely clamping it all around the opening 26. The cut-off wire 35 then lowers onto the film in the space between the rear clamp and the grippers, severing the strip of film at this location. A head of lettuce L is then carried by the pivoted fingers 36 into a centered position over the section of film held over the opening 26, at which time the fingers pivot downwardly to release the head of lettuce onto the film. Ram 37 then lowers onto the head of lettuce, pushing it downwardly against the film and through the opening to a predetermined distance below the opening (typically about 12 inches), stretching the film and partially forming a bag-like enclosure around the lettuce, with the film tightly engaging the lettuce over its lower hemisphere and stretched upwardly therefrom to the clamps. The ram is then withdrawn, and the front, rear and side clamps raise away from the film, releasing it except at the center of the opposite sides of the opening, where the center side clamps remain lowered against the film.

The film gathering, sealing and trimming means then operates, as seen best with reference to FIGS. 4–6 and 10–15. Immediately following retraction of the ram and the front, rear and side clamps, the gathering bars 38 and 39 move toward one another, gathering the film overwrap above the head of lettuce into an elongate flattened condition (see FIG. 10) held at its opposite side edges by the center side clamps. It will be noted that the central portions 38*a* and 39*a* of the opposed gathering bars are slightly wider than the ends, whereby the flattened section of gathered film is clamped at a central portion thereof by the bars, while remaining essentially free toward the outer edges of the flattened section. The widened central portions are shown exaggerated in the drawings for purpose of illustration. The center side clamps 31 and 32 then release, and the U-channel 40 and sealing and trimming means 41 move toward one another, with the arms of the U-channel extending above and below the sealing and trimming means, gathering the flattened section of film into a narrow, necked down condition (see FIG. 12).

As seen best in FIGS. 10 and 13–16, the sealing and trimming means 41 comprises a set of double clamps or upper and lower sets 44 and 45 of pinch fingers that are mounted for movement together as a unit toward the U-channel. The pinch fingers are spaced apart as the sealing and trimming means and U-channel move toward one another (see FIG. 13), and the legs of the U-channel are spaced apart to extend above and below the pinch fingers when the U-channel and sealing and trimming unit meet, whereby the gathered film is collected and pushed by the legs of the U-channel into the space between the fingers. Movement of the U-channel and sealing means toward one another is limited by engagement of the U-channel against a stop 46 on the sealing and trimming means. When the U-channel hits the stop, the upper and lower sets of pinch fingers move toward one another to clamp the necked down film between them (see FIG. 14). The heated sealing bar 42 then presses against the necked down section of film in the area between the upper and lower sets of pinch fingers, fusing it together in this area to form a seal. A release material (not shown) between the sealing bar and the film prevents adherence of the heated film to the sealing bar. The upper set of pinch fingers 43, which are still clamped together on the film, pivot away to the position shown in broken lines in FIG. 15 (the fingers 43 are shown in open position in this figure, although it should be understood that they are in closed position as they pivot to this position), tearing the excess film away from the sealed area clamped by the heated sealing bar 42. The sealing bar then retracts, and the lower set of pinch fingers 44, which grip the gathered film in the area between the head of lettuce and the seal, supporting the wrapped head of lettuce, then open, releasing the wrapped head of lettuce to fall onto a take-away conveyor (not shown). The upper set of pinch fingers also open at this time, as shown by the broken lines in FIG. 15, releasing the trim so that it can be vacuumed away.

Figure 19:
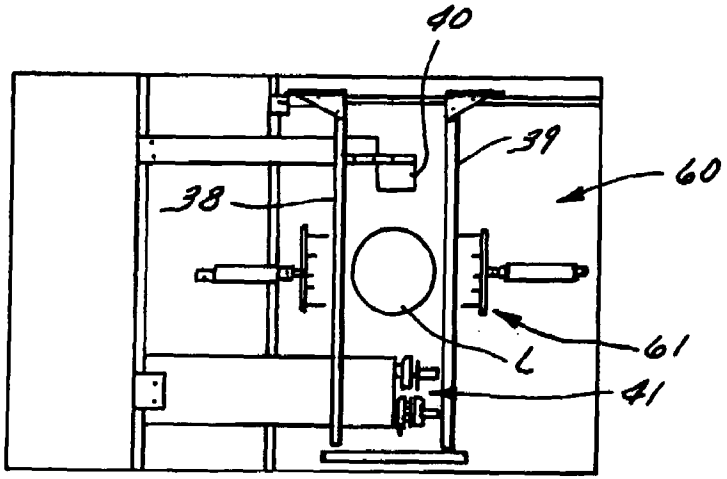
FIG. 19 is a schematic, fragmentary, top plan view of a perforating means that can be used to perforate the stretched film to facilitate vacuum cooling of the package.
Figure 20:
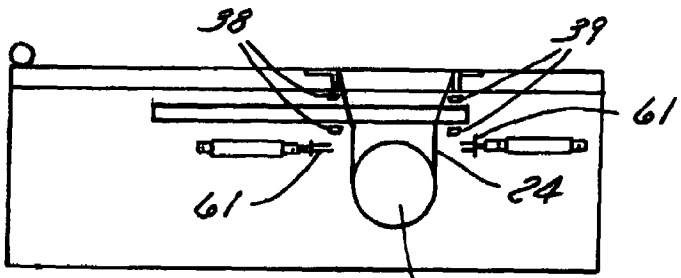
FIG. 20 is a schematic side view in elevation of the mechanism of FIG. 19.

A perforating means 60 for making small holes in the film to facilitate vacuum cooling can be provided, if desired, as shown in FIGS. 19 and 20. The perforating means comprises a plurality of pointed rods 61 carried for reciprocation toward and away from the film to form holes in the film in the area above the center of the partially wrapped head of lettuce where the stretched film is spaced from the lettuce.

Although particular embodiments of the invention are illustrated and described in detail herein, it is to be understood that various changes and modifications may be made to the invention without departing from the spirit and intent of the invention as defined by the scope of the appended claims.

What is claimed is:

1. Apparatus for automated stretch wrapping of articles in a stretchable transparent film, comprising:

means for holding a supply of the film;

film advancing means for advancing the film forwardly over an opening at a wrapping station;

film clamping means for holding the film in a generally planar web across the opening;

means for placing an article to be wrapped on the film web at the wrapping station;

means for pushing the article against the film and through the opening to stretch the film and form a bag-like enclosure at least partially enveloping the article; and film gathering, sealing and trimming means adjacent the opening for gathering excess film material extending between the opening and the article, said film gathering, sealing and trimming means operative to gather the film in two stages to fully envelope the article, including a first stage in which the film is gathered into a generally flattened condition, and a second stage in which the film is further gathered into a necked down condition, and said sealing and trimming means is operative to engage the necked down film to seal it and separate the excess film from the stretch-wrapped article.

2. Apparatus as claimed in claim 1, wherein:

the film supply comprises an elongate strip of film in a supply roll supported in spaced relationship to the film advancing means; and said film advancing means includes film gripping means for gripping and holding a leading edge of the film, said film gripping means being movable in a forward direction from a retracted position rearwardly of said opening to an extended position forwardly of the opening where it releases the film, and movable in a rearward direction to its retracted position where it again grips the film in preparation for advancing another section of film over the opening.

3. Apparatus as claimed in claim 2, wherein:

said film advancing means further comprises a film unwind roller engaged with the strip of film and movable forwardly with the film gripping means, said film unwind roller being mounted for movement in said rearward direction independently of movement of the gripper means and operative to unwind additional film from the supply roll as the unwind roller is moved in said rearward direction, said movement in said rearward direction being slower than said movement in said forward direction to avoid placing undue stress on the film as it is unwound from the supply roll.

4. Apparatus as claimed in claim 3, wherein:

a dancer roller is yieldably engaged with the strip of film between the supply roll and the film unwind roller to maintain a predetermined light tension on the film as it is unwound from the supply roll.

5. Apparatus as claimed in claim 3, wherein:

first actuating means is connected with said film gripping means to move it in said forward and rearward directions; and link means is connected between said first actuating means and said film unwind roller to cause said film unwind roller to move with said film gripping means in said forward direction.

6. Apparatus as claimed in claim 5, wherein:

said link means is free of connection with said first actuating means upon movement of said first actuating means in said rearward direction; and second actuating means is connected with said film unwind roller to move it in said rearward direction independently of rearward movement of said film gripper means, said rearward movement of said link means and film unwind roller being slower than rearward movement of said first actuating means and said film gripper means.

7. Apparatus as claimed in claim 2, wherein:

said film clamping means comprises a plurality of clamps arranged around said opening to clamp said film at the forward, rearward and opposite sides of the opening, and include a front clamp at the forward edge of the opening, a rear clamp at the rearward edge of the opening, and side clamps at the opposite side edges of the opening to securely hold the film in place all around the opening.

8. Apparatus as claimed in claim 7, wherein:

actuator means is connected with said front, rear and side clamps to cause said front clamp to engage and hold said film prior to said gripper means releasing and moving to their retracted position, and to cause said side and rear clamps to engage and hold said film after said gripper means has moved rearwardly away from said opening.

9. Apparatus as claimed in claim 8, wherein:

center side clamps are positioned at the sides of said opening generally centrally located with along the sides of said opening; and actuator means is connected with said center side clamps to cause them to engage and disengage said film independently of movement of said side clamps, said center side clamps being operative to hold central side portions of the film as it is being gathered and after the front, rear and side clamps have released.

10. Apparatus as claimed in claim 1, wherein:

said film gathering, sealing and trimming means includes a pair of gathering bars positioned between the opening and an article partially enveloped in said film after the article has been moved against the film and through the opening to stretch the film, said gathering bars being movable in forward and rearward directions toward and away from one another to gather the stretched film extending between the opening and the article into said generally flattened condition.

11. Apparatus as claimed in claim 10, wherein:

said film gathering, sealing and trimming means further includes film sealing and trimming means at opposite sides of said opening and movable toward and away from one another to gather said flattened film into said necked down condition.

12. Apparatus as claimed in claim 11, wherein:

said film sealing and trimming means comprises a U-channel member at one side of said opening, and a pair of normally spaced apart movable pinch fingers at the other side of said opening, said U-channel member being operative to push the film flattened by the gathering bars into the space between the pinch fingers as the U-channel member and pinch fingers move toward one another, whereby the flattened film is further gathered into said necked down condition.

13. Apparatus as claimed in claim 12, wherein:

said gathering bars each comprise a pair of bars arranged one above the other and spaced apart a distance sufficient to extend above and below the U-channel member and the pinch fingers as they move toward one another.

14. Apparatus as claimed in claim 13, wherein:

the pinch fingers are movable toward one another to grip the film after it has been gathered into said necked down condition; and sealing means is movable into engagement with the necked down film to fuse it and form a seal while the film is being held by the pinch fingers, thereby producing a shrink-wrapped article.

15. Apparatus as claimed in claim 14, wherein:

the pinch fingers comprise an upper set of pinch fingers and a lower set of pinch fingers spaced from the upper set, said sealing means being engageable with the necked down film in the area between the upper and lower sets of pinch fingers to form said seal, and said upper set of pinch fingers is pivotable as a unit from a first position aligned with the U-channel member to a second position angularly disposed with respect to the U-channel member, said movement of said upper set of pinch fingers from their first position to their second position serving to separate excess film from the sealed area, and said lower set of pinch fingers being operative to support the wrapped article; and said pinch fingers in said upper and lower sets being movable away from one another, with the pinch fingers in said upper set being movable away from one another to release the excess film gripped therebetween when the pinch fingers are in their second position, and the pinch fingers in the lower set are movable away from one another while in their original position to release the wrapped article to fall onto a take-away conveyor.

16. Apparatus for automated stretch wrapping of an article in a stretchable transparent film, comprising:

means for advancing and holding a section of thin, stretchable, transparent film over an opening at a wrapping station;

means for pushing an article to be wrapped against the film and through the opening to stretch the film and form a bag-like enclosure at least partially enveloping the article; and film gathering, sealing and trimming means adjacent the opening for gathering excess film material extending between the opening and the article, said film gathering, sealing and trimming means operative to gather the film in two stages to fully envelope the article, including a first stage in which the film is gathered into a generally flattened condition, and a second stage in which the film is further gathered into a necked down condition, and said sealing and trimming means is operative to engage the necked down film to seal it and separate the excess film from the stretch-wrapped article.

17. Apparatus for automated stretch wrapping of fresh heads of lettuce at the point of harvest of the lettuce, comprising:

means for mounting the apparatus on an existing lettuce harvesting machine adapted to be moved through a field of lettuce to harvest and bag the lettuce;

means for supporting on the apparatus a supply of stretchable transparent film;

film advancing means for moving a strip of the film from the supply to a film wrapping station on the apparatus;

clamping means for holding a section of the strip of film in place over an opening at the wrapping station;

means for placing a head of freshly harvested lettuce in the center of the section of film;

means for stretching the section of film held over the opening and moving the head of lettuce through the opening to a position spaced below the opening;

film gathering means for gathering the film stretched between the opening and the head of lettuce; and film sealing and trimming means for sealing the film adjacent the head of lettuce and trimming excess film from the sealed head of lettuce.

* * * * *